United States Patent [19]

Abe et al.

[11] Patent Number: 4,858,345

[45] Date of Patent: Aug. 22, 1989

[54] FRONT FRAMES OF WHEEL MOUNTED TYPE LOADERS

[75] Inventors: Tsutomu Abe, Hidaka; Hiromichi Miyashita, Kawagoe, both of Japan

[73] Assignee: Kabushiki Kaisha Komatsu Siesakusho, Tokyo, Japan

[21] Appl. No.: 261,960

[22] PCT Filed: Feb. 2, 1988

[86] PCT No.: PCT/JP88/00095

§ 371 Date: Sep. 30, 1988

§ 102(e) Date: Sep. 30, 1988

[87] PCT Pub. No.: WO88/05845

PCT Pub. Date: Aug. 11, 1988

[30] Foreign Application Priority Data

Feb. 4, 1987 [JP] Japan ..... 62-14293

[51] Int. Cl.[4] ..... E02F 3/00

[52] U.S. Cl. ..... 37/118 R; 414/686

[58] Field of Search ..... 37/118 R, 118 A, DIG. 15; 414/686, 685, 710, 723, 727

[56] References Cited

U.S. PATENT DOCUMENTS

| | | | |
|---|---|---|---|
| 2,972,424 | 2/1961 | Cadwell | 414/686 |
| 3,732,996 | 5/1973 | Bauer | 414/686 |
| 4,208,162 | 6/1980 | Neitzel | 414/686 |
| 4,222,186 | 9/1980 | Molby | 414/686 X |

FOREIGN PATENT DOCUMENTS

| | | | |
|---|---|---|---|
| 899929 | 6/1962 | United Kingdom | 37/118 R |
| 930192 | 7/1963 | United Kingdom | 37/118 A |
| 940335 | 10/1963 | United Kingdom | 37/118 A |

*Primary Examiner*—Eugene H. Eickholt

*Attorney, Agent, or Firm*—Diller, Ramik & Wight

[57] ABSTRACT

This invention relates to a front frame (50) constituting a front portion (2) of a so-called articulated wheel mounted type loader (1) of a vehicle in which the front portion (2) and a rear portion (3) are separated but coupled together. The front frame (50) is constituted by a lower frame (20) adapted to support the front frame, and a upper frame (40) secured to the lower frame (20) and formed with a bucket cylinder pivot (32), a boom pivot (30) and a boom cylinder pivot (31). Particularly, the upper plate (40) is made up of a single plate (41) provided with a bucket cylinder pivot (30) and a boom pivot (30) and a pair of boom cylinder pivot members (42) connected to both ends of the single plate (41) and respectively provided with boom cylinder pivots (31). Pivot openings are provided for the upper frame (40). The upper frame (40) is handled as a unit when the upper frame (40) is mounted on the lower frame (20).

3 Claims, 3 Drawing Sheets

FRONT FRAMES OF WHEEL MOUNTED TYPE LOADERS

FIELD OF ART

This invention relates to a so-called articulate type wheel mounted loader in which the front and rear sides are separated and interconnected, and more particularly an improvement of a front frame that constitutes the front part of the wheel mounted type loader.

BACKGROUND ART

FIG. 3 is a diagrammatic side view showing a conventional wheel mounted loader.

This wheel mounted loader 1 is a so-called articulated type wheel mounted loader and is constituted by a front frame 2 which constitutes the essential portion of the front portion of the wheel and a rear frame 3 separate from the front frame 2 and constitutes the essential portion of the rear portion of the frame. These front frame 2 and the rear frame 3 are interconnected by a center hinge pin 4 as shown in FIG. 4 taken along a line A—A in FIG. 3.

Reference numerals 4 and 5 shown in FIG. 3 respectively show the front wheel and the rear wheel of the wheel mounted type loader 1, while reference numerals 6, 7, 8 and 9 respectively show a bucket, a boom, a bucket cylinder and a boom cylinder. Reference numeral 10 shown in FIG. 4 represents steering cylinders, while 11 represents pivot pins of the steering cylinders.

The prior art front frame 2 of the wheel mounted loader 1 described above will be described in detail.

FIG. 5 is a diagrammatic perspective view showing a prior art front frame 2. The front frame 2 is constituted by a lower frame 20 constituting the lower portion of the front frame 2, and a upper frame 21 mounted on the upper portion of the lower frame 20 and formed with various bearing openings.

The lower frame 20 is constituted by a front face plate 22 covering the front surface of the front frame 2, and a pair of side plates 23 covering the side surfaces, whereas the upper frame 21 is constituted by a upper plate 24 covering the upper portion of the front frame 2, and a pair of side plates 25 which are separate from the side plates 23 and arranged on both sides of the upper portions of the side plates 23. The pair of side plates 25 are welded to the side surfaces of the side plates 23 through reinforcing ribs 26, whereby the side plates 25 are securely fastened to the side surfaces of the side plate 23.

In FIG. 5, reference numeral 30 designates a pair of boom pivots formed through the side plates 23 and 25 respectively, 31 designates a pair of boom cylinder pivot pins provided for the side plates 25, and 32 designates bucket cylinder pivots formed at the center of the upper plate 24.

With the front frame 2 described above, since the axle mounting portion 33 journalling the front wheel 4 (FIG. 3), the boom mounting portion 34 and the bucket cylinder mounting portion 35 are subjected to external force, these members are connected by welding, to the front plate 22 acting as a main reinforcing member, the side plates 23 and a center hinge 4 (FIG. 4) so as to withstand the external force. In addition, the independent side plates 25 respectively formed with boom pivots 30 and the boom cylinder pivots 31 are also connected to the side plate 23 by welding through a reinforcing rib 26. As a consequence with the construction of the prior art front frame 2, since the number of component parts and the number of welds are very large, the number of assembling steps increases, thereby decreasing the efficiency of the assembling operation and increasing the cost of manufacturing.

For the purpose of increasing the reliability and durability of the wheel mounted loader 1, it is necessary to increase the accuracy of the centers of respective pivots of the front frame 2, especially those of a pair of left and right boom pivots 30, and a pair of left and right boom cylinder pivots 31. According to the prior art construction, since the pair of left and right beam pivots 30 and the pair of boom cylinder pivots 31 described above are respectively formed on a pair of side plates 25 which are independent members. Furthermore, for the purpose of welding together, as it is necessary to position the pair of side plates 25 which have been previously formed with pivot openings before the welding operations are effected, there is a defect that the centering accuracies of respective pivots decrease due to the difficulty of ensuring the positioning accuracy of respective side plates at the time of welding as well as due to an elongation and contraction at the time of solidification of the welded metal.

In view of the problems described above, it is the object of this invention to provide a front frame of the wheel mounted type, which bears low cost and high reliability and durability by reducing the number of parts and welds of the upper frame constituting the upper portion of a front frame and by improving the center accuracy of pivot openings formed in the upper frame.

DISCLOSURE OF THE INVENTION

According to this invention, the upper portion of the front frame is constituted by at least one rigid plate thicker than other parts constituting the front frame and formed with a bucket cylinder pivot and a boom pivot, and a pair of plate shaped boom cylinder pivot members connected to the opposite ends of the single plate and formed with boom cylinder pivots, thereby integrating the upper frame as a unit constituting the upper portion of the front frame. The front frame can be assembled by merely mounting the integrated upper frame of the front frame on the lower frame constituting the lower portion of the front frame and then welding the upper frame and the lower frame together. Consequently, the number of parts of the upper frame constituting the upper portion of the frame can be reduced so that the number of welds applied at the time of assembling the entire front frame can also be reduced. Moreover, as the upper plate is integrated by using the single plate of the upper plate as the base, it becomes possible to integrally provide the pivot openings thereby enabling to obtain a low cost wheel mounted type loader having improved center accuracy of respective pivots as well as high reliability and durability.

BEST FORM FOR WORKING OUT THE INVENTION

Figure 1:
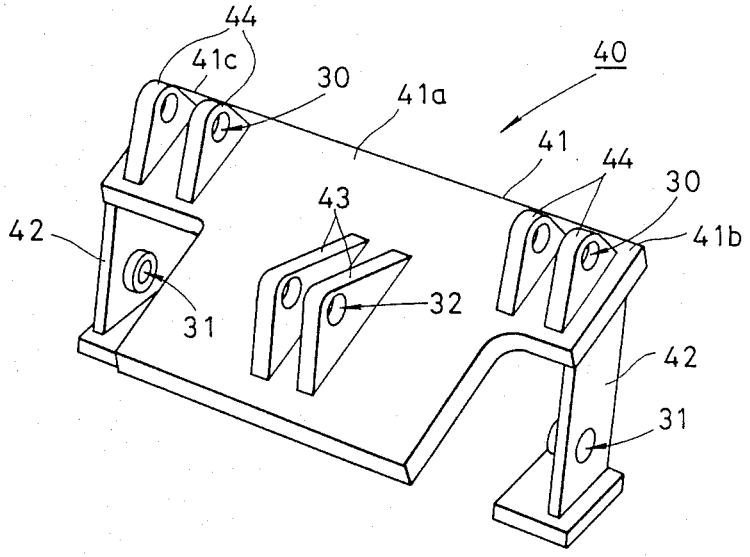
FIG. 1 is a diagrammatic perspective view of the upper frame constituting the upper portion of the front frame according to this invention.
Figure 5:
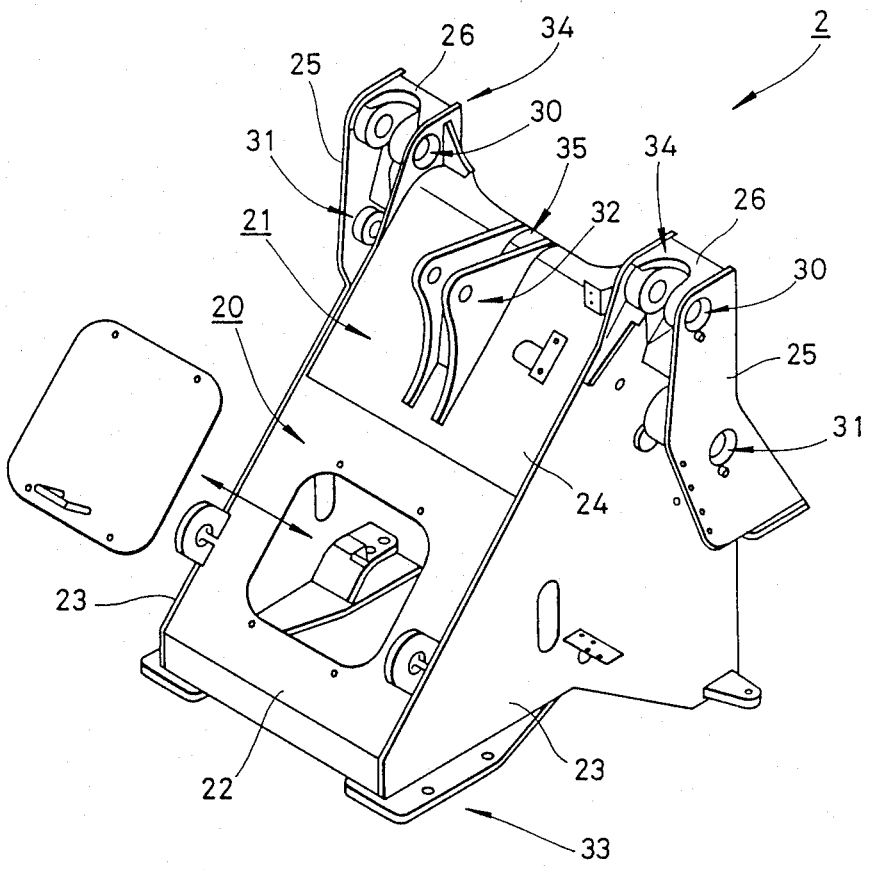
FIG. 5 is a diagrammatic perspective view showing a prior art front frame.

FIG. 1 is a diagrammatic perspective view of the upper frame 40 constituting the upper portion of the front frame according to this invention in which parts identical to those shown in FIG. 5 are designated by the same reference numerals.

The upper frame 40 is constituted by a rigid single plate 41 thicker than other component parts of the front frame to be described later, and a pair of boom cylinder pivot members 42 disposed beneath the opposite ends of the single plate 41. The upper frame 40 is constituted by extremely smaller number of parts than the prior art upper frame. The boom cylinder pivot member 42 is made of a member having an L shaped cross-section. The boom cylinder pivot member 42 is formed integral with the single plate 41 by welding or integral casting.

With this construction of the upper frame 40, at the time of machining the upper frame 40 or mounting it on the lower frame to be described later, it is possible to handle the entire upper frame as a unit.

A pair of brackets 43 respectively formed with a bucket cylinder pivot 32 are secured to the upper surface 41*a* of the single plate 41 by welding or integral casting. To the opposite ends 41*b* and 41*c* of the upper surface 41*a* of the single plate 41 are secured a pair of brackets 44 each formed with a beam pivot 30 by welding or integral casting.

With such integrated upper frame 40, pivot openings can be formed for the brackets 43, 44 and boom cylinder pivot members 42 from their sides by a boring tool such as a boring machine, not shown. For this reason, it is possible to provide the pair of brackets 43 with bucket cylinder pivots 32 having a high center accuracy. Furthermore, beam pivots 30 each having a high center accuracy can be formed for the pair of brackets 44 and boom cylinder pivots 31 each having a high center accuracy can be provided for the pair of boom cylinder pivot members 42. As a result, by inserting pivot pins of booms or cylinders, not shown, into respective pivots, since the center accuracies of respective pivots are high, one side wear of the pivot pins of respective pivots and booms or cylinders, etc. will not occur. This greatly improves the accuracy and durability of the wheel mounted type loader.

Figure 2:
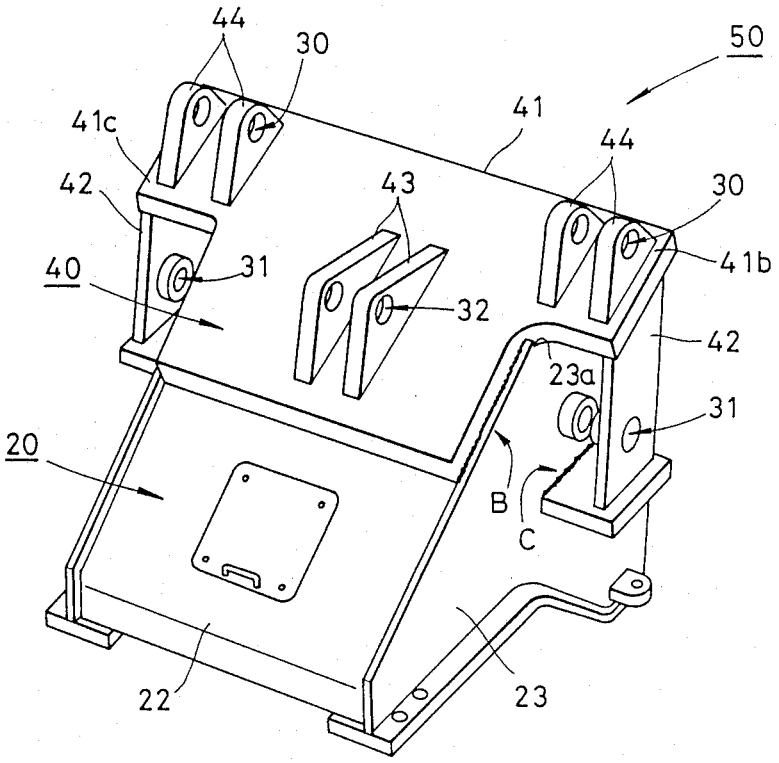
FIG. 2 is a diagrammatic perspective view showing a front frame embodying this invention.
Figure 3:
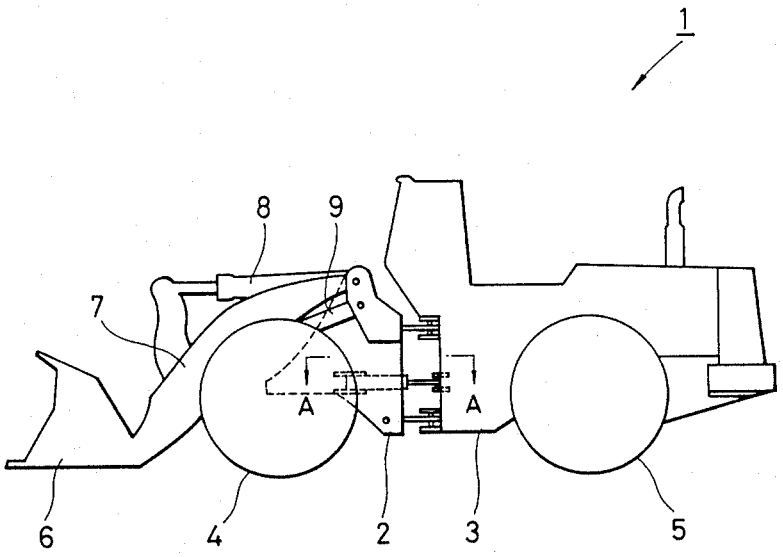
FIG. 3 is a diagrammatic side view showing the wheel mounted type loader.
Figure 4:
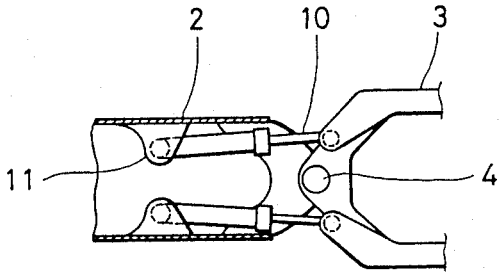
FIG. 4 is a sectional view taken along a line A—A in FIG. 3.

Thus, when the integrated upper frame 40 provided with openings of respective pivots (bucket cylinder pivots 32, arm pivots 30 and boom cylinder pivots 31) is mounted on the upper portion of the lower frame 20 of the front frame 50 of this invention shown in FIG. 2, in which elements corresponding to those shown in FIG. 5 are designated by the same reference numerals. And when contact portions between the lower frame 20 and the upper frame 40, that is a total of 4 contact portions shown by arrows B and C are welded together, the lower frame 20 and the upper frame 40 constituting the front frame 50 are rigidly secured together, thereby assembling the entire portions of the front frame 50. As a consequence, in this embodiment the member of welds necessary to assemble the front frame 50 is extremely small so that it is possible to decrease the number of assembling compared with the prior art construction so that the front frame can be provided at a low cost.

Reference numeral 23*a* shown in FIG. 2 represents a shoulders formed at the upper portion of the side plate 23 constituting the lower plate 20. These shoulders 23*a* engage end portions 41*b* and 41*c* of the single plate 41 constituting the upper frame 40 so as to position the single plate 41 on the lower frame 20.

It should be understood that the invention is not limited to the shown and described embodiment and that various embodiment can be made within the scope of the claims.

INDUSTRIAL APPLICABILITY

As above described, the front frame embodying this invention is suitable for use in a wheel mounted type loader requiring reliability and durability.

What is claimed is :

1. A front frame for a wheel mounted type loader comprising a lower frame for supporting a front wheel and a upper frame secured to said lower frame and formed with a bucket cylinder pivot, a boom pivot and a boom cylinder pivot, characterized in that said upper frame comprises a single plate formed with said bucket cylinder pivot and said boom pivot, and a pair of boom cylinder pivot members formed with said boom cylinder pivot.

2. The front frame according to claim 1 characterized in that said single plate has a larger thickness than other component parts constituting said front frame.

3. The front frame according to claim 1, characterized in that each of said boom cylinder pivot members is a plate member having an L shaped cross-section.

* * * * *